US007530849B2

(12) United States Patent
Colosio

(10) Patent No.: US 7,530,849 B2
(45) Date of Patent: May 12, 2009

(54) LAMP HOLDING DEVICE

(75) Inventor: Livio Colosio, Iseo (IT)

(73) Assignee: E.M.C. Colosio S.p.A., Provaglio D'Iseo (IT)

( * ) Notice: Subject to any disclaimer, the term of this patent is extended or adjusted under 35 U.S.C. 154(b) by 42 days.

(21) Appl. No.: 11/662,455

(22) PCT Filed: Sep. 7, 2005

(86) PCT No.: PCT/IT2005/000512

§ 371 (c)(1),
(2), (4) Date: Mar. 9, 2007

(87) PCT Pub. No.: WO2006/027816

PCT Pub. Date: May 16, 2006

(65) Prior Publication Data

US 2008/0132117 A1 Jun. 5, 2008

(30) Foreign Application Priority Data

Sep. 10, 2004 (IT) ..... BS2004A0099

(51) Int. Cl.
*H01R 33/09* (2006.01)

(52) U.S. Cl. ..... 439/619; 439/699.1; 439/699.2

(58) Field of Classification Search ..... 439/699.1, 439/699.2, 619, 229
See application file for complete search history.

(56) References Cited

U.S. PATENT DOCUMENTS 5,000,702 A * 3/1991 Forish et al. ..... 439/699.2
6,039,579 A * 3/2000 Paul et al. ..... 439/56
6,971,917 B2 * 12/2005 Faust et al. ..... 439/619
2003/0068929 A1 * 4/2003 Powers et al. ..... 439/699.2

FOREIGN PATENT DOCUMENTS

DE 28 48 004 A1 5/1980
DE 201 00 762 U1 3/2001

OTHER PUBLICATIONS

Philips Lighting: "Light, Innovation and more," Apr. 30, 2004, http://www.lighting.philips.com/DE_DE/tools_downloads/downloads/light_innovation_more/I_and_building.pdf, XP002360309, pp. 35-37, 54.

(Continued)

*Primary Examiner*—Tho D Ta
*Assistant Examiner*—Travis Chambers
(74) *Attorney, Agent, or Firm*—Pearne & Gordon LLP

(57) ABSTRACT

It is provided a lamp holding device (1) comprising a supporting element (14) made of an electrically insulating material and having a housing space (15). An electrically insulating hollow body (49 is disposed within the housing space (15) and is set to receive an end portion (3) of a lamp (2). Said hollow body (4) has a pair of electric contacts (7) each of which can be associated with a respective conductive element projecting from the end portion (3) of the lamp (2). Each electric contact (7) comprises first and second resilient counter-elements (9, 10) which are both movable between an opened position to enable passage of the respective conductive element and a constraint position to lock the conductive element. Each resilient counter-element has a contact surface (9*a*, 10*a*) adapted to abut onto a respective side wall of the conductive element.

25 Claims, 13 Drawing Sheets

OTHER PUBLICATIONS

Philips Lighting: "Mini Master Color CDM-TM Lamps," Dec. 31, 2004, http://wwww.nam.lighting.philips.com/us/ecatalog/hid/pdf/P-5722.pdf, XP002360310, entire document.

"Neuheiten 2004," Dec. 31, 2004, Bender & Wirth, http://www.bender-wirth.com/pdf/catsup.pdf, XP002360311, pp. 1-5.

* cited by examiner

LAMP HOLDING DEVICE

FIELD OF THE INVENTION

The present invention relates to a lamp holding device.

BACKGROUND OF THE INVENTION

In particular, the invention relates to a holding device commonly known as "lamp holder" or "lamp socket", adapted to associate a lamp with the respective energised electric contacts and to ensure interchangeability. Lamp holders, generally made of an electrically insulating material, further allow assembling of same to bodies of lighting apparatus of different kinds constituting spotlights or floodlights, for example.

In more detail, the present invention advantageously applies, as a lamp holding device, to the lamps of new conception identified by the abbreviation PGJ5, which lamps have a rated voltage of 250 V and an impulse voltage of 1500 V. Such lamps, like the lamp Philips® CDM 20 W 250V with ballast ignition providing impulse discharges up to 1500 V, consist of a bulb made of glass and having a substantially oval shape, from which the light is emitted.

Extending from the opposite side of the bulb is an end portion from which two electric-connection elements project the shape of which is adapted to enable association with respective electric contacts. In particular, the connection elements extend opposite each other and transversely to the longitudinal extension of the lamp.

Generally, each connection element has a substantially parallelepiped conformation with a square cross-section, in which four faces are defined at least one of which is arranged to be associated with a respective electric contact of the lamp holding device.

It is known that lamp holding devices of the above mentioned type consist of a ceramic body of a substantially cylindrical conformation in which a bore for passage of the lamp is formed. In more detail, the bore has a substantially elongated shape in which two opposite ends are defined to enable passage of the electric contacts.

In this manner when the lamp is inserted into the bore, the lamp is rotated around its longitudinal axis in such a manner that its end portions are disposed in correspondence with two electric contacts (bayonet coupling).

Generally, the electric contacts consist of laminar portions made of a conductive material (metal) and are inserted into suitable spaces formed in the ceramic body on opposite sides of the passage bore for the lamp. Each electric contact is connected to a power cord by means of a suitable welding, and has a conveniently shaped flat surface to get in contact with a respective face of a connection element.

In this manner, when the lamp is inserted in the ceramic body, the lamp itself is rotated until respective faces of the two connection elements abut against the respective flat surfaces of the electric contacts.

Also known are lamp-i holding devices in which the electric contacts consist of a resilient flat spring.

In this case, when the lamp is rotated about its longitudinal axis the connection element abuts against the spring which is maintained in a compressed state.

Advantageously, by the resilient thrust of the flat spring, the electric contact is maintained steadily associated with the connection element to ensure a continuous electric connection.

Known lamp holding devices further have suitable seats such arranged as to enable housing of fastening screws to associate the device itself with any frame, such as a structure of lighting apparatuses like spotlights or floodlights, for example.

The screws are fitted in respective through holes formed in the ceramic body and disposed on opposite sides of the lamp. To facilitate mounting operations of the device, the screws are inserted from the bulb portion of the lamp so as to arrange the respective head towards the outside of the ceramic body.

The above described known art however has some important drawbacks.

First of all, it is to be pointed out that the above described lamp holding devices are not very reliable as regards the electric connection between the device contacts and the lamp connection elements. In fact, due to possible movements of the holding device, the lamp may slightly rotate causing separation of the connection elements from the electric contacts.

Also in the described solution in which the electric contacts consist of a flat spring, an unintentional slight movement of the lamp can cause separation of the connection elements from the electric contacts, which will bring about lack of distribution of electric energy.

Furthermore, a further drawback resides in that known devices enable insertion and energising also of lamps having operating features different from the provided ones.

In fact, due to the structure of the electric contacts, any connection element can get into engagement with the electric contacts irrespective of its shape. It is in fact to be noted that an electric connection is defined through coupling of a face of each connection element with a respective flat surface of the electric contact. Therefore insertion of a lamp with a different type of connection is possible, such as a lamp with a connection of the "G9" type. Insertion of a non suitable lamp into the holding device gives rise to important drawbacks, such as burst of the lamp if it is overpowered because the operating features of the lamp are different from the expected ones.

A further drawback relates to positioning of the seats for the hooking screws distributed in the ceramic body. In fact the ceramic body, generally made of steatite, is very fragile. This fragility is due not only to the material of which the body is made, such as said ceramic material, but also to the fact that the body itself has a very wide cavity and very thin walls in order to enable a bayonet coupling of the lamp.

Therefore, tightening of the screws could cause breaks and cracks in the ceramic body which will give rise to damage of the whole device.

In addition, due the presence of a crack in the ceramic body no electric insulation exists between the energised parts and the screw. Under this situation, the screw head being is disposed externally and in sight could be dangerously energised.

SUMMARY OF THE INVENTION

The technical task underlying the present invention is to devise a lamp holding device capable of substantially obviating the mentioned drawback.

Within the scope of this technical task it is an important aim of the invention to devise a lamp holding device, in particular for lamps identified by the abbreviation PGJ5 having a rated voltage of 250V and an impulse voltage of 1500V, capable of ensuring a steady electric contact between the lamp and the electric contacts even in the event of slight movements of the whole device.

Another important aim of the invention is to devise a lamp holding device capable of enabling coupling exclusively with a single preestablished lamp type, i.e. with a lamp having a PGJ5 connection or base. In more detail, it is an aim of the present invention to make the holding device only adapted for coupling with lamps having given operating features.

Finally, it is a further aim of the present invention to make available a lamp holding device adapted for coupling with a respective frame without damaging the structure thereof. In addition it is an aim of the invention to make available a lamp holding device capable of ensuring an electric insulation of the "second" class, i.e. as provided by the rules in force, which does not require building of an apparatus provided with earthing, while at the same time maintaining particularly reduced sizes.

The technical task mentioned and the aims specified are substantially achieved by a lamp holding device of the type comprising the features described in the appended claims.

BREIF DESCRIPTION OF THE DRAWINGS

Description of a preferred but not exclusive embodiment of a device in accordance with the invention is now given hereinafter and illustrated in the accompanying drawings, in which.

Figure 1:
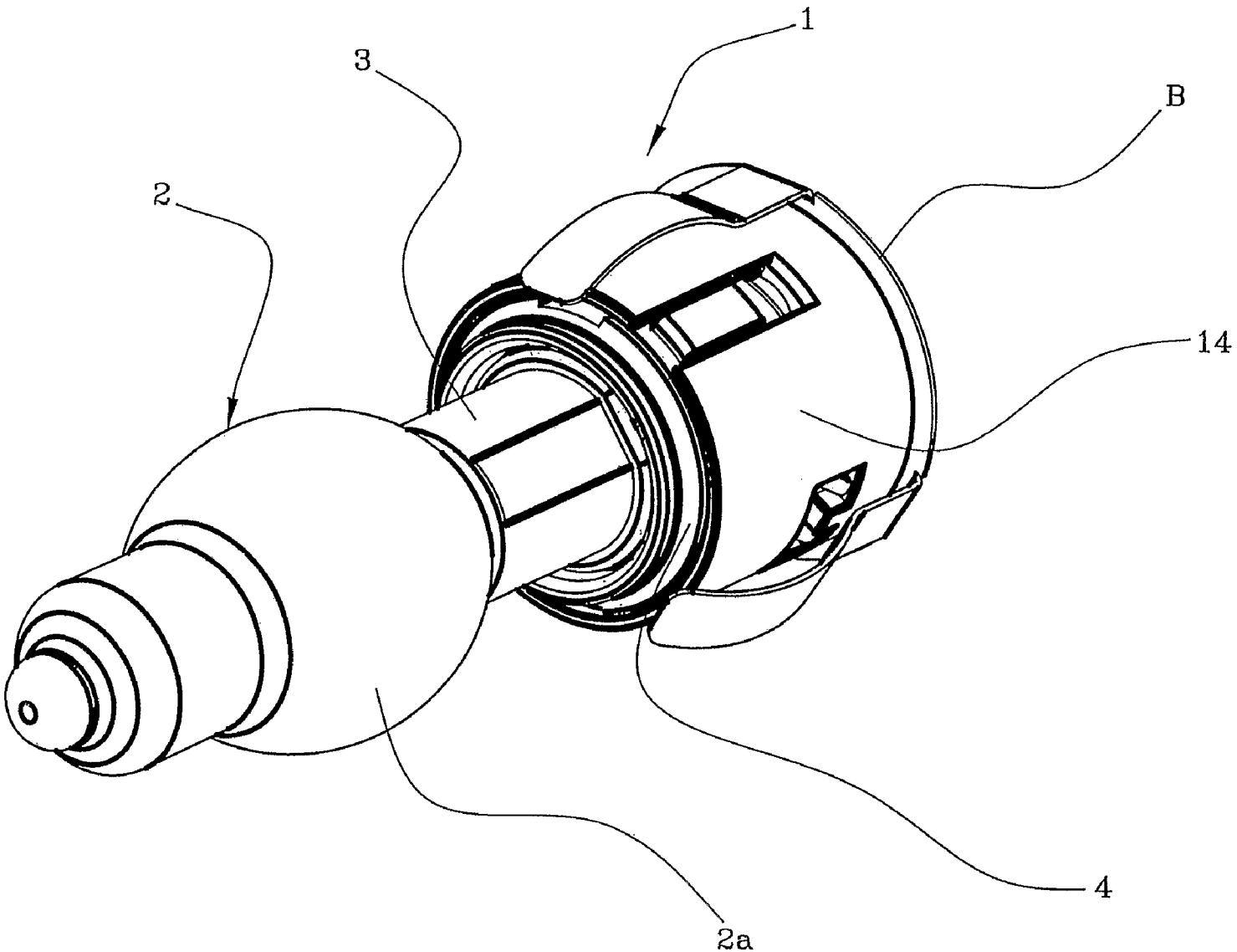
FIG. 1 shows a perspective view of the holding device in accordance with the invention coupled with a respective lamp and with a frame B.
Figure 2:
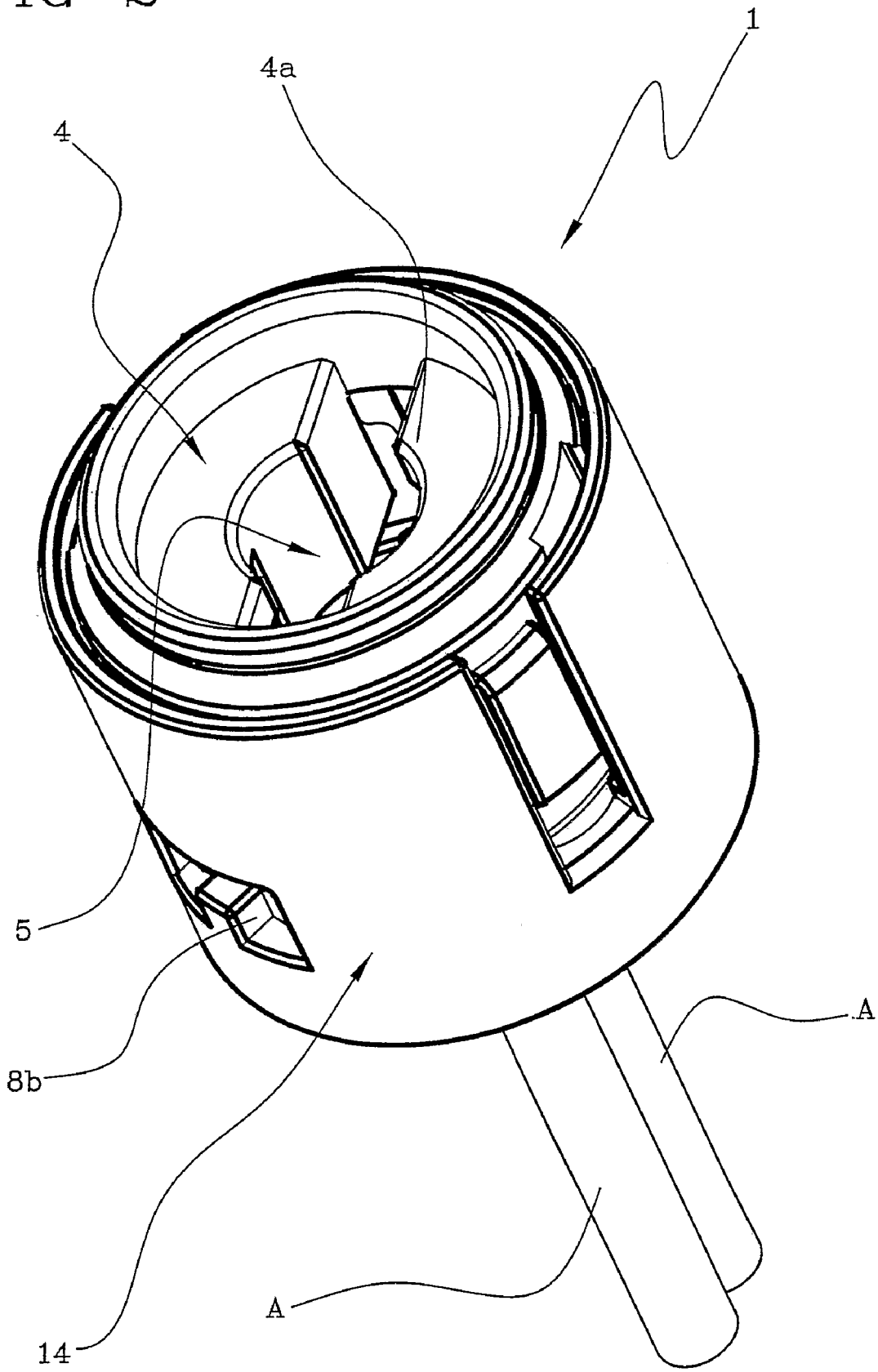
FIG. 2 is a perspective view of the device in FIG. 1 uncoupled from said lamp.
Figure 4:
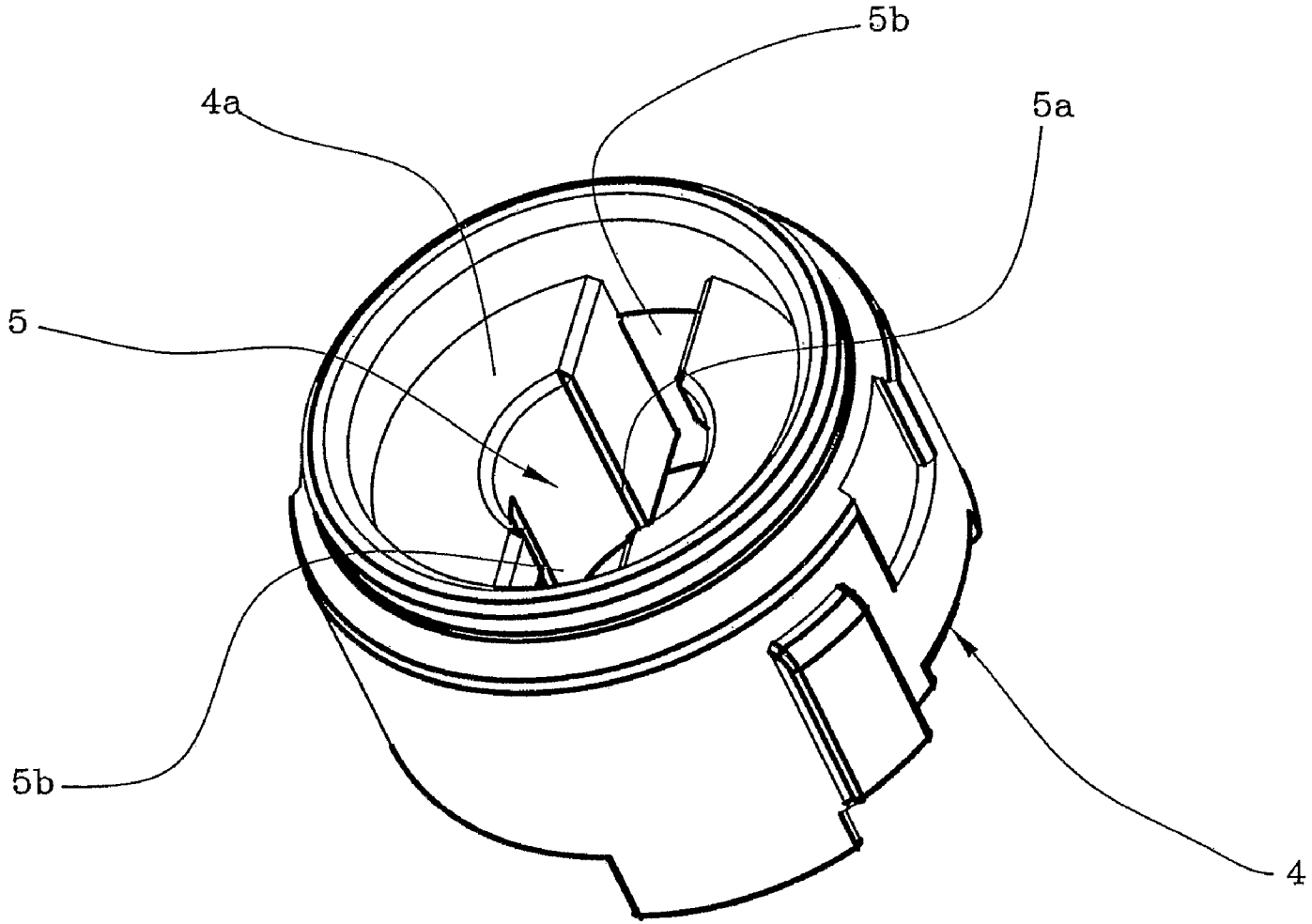
Figure 5:
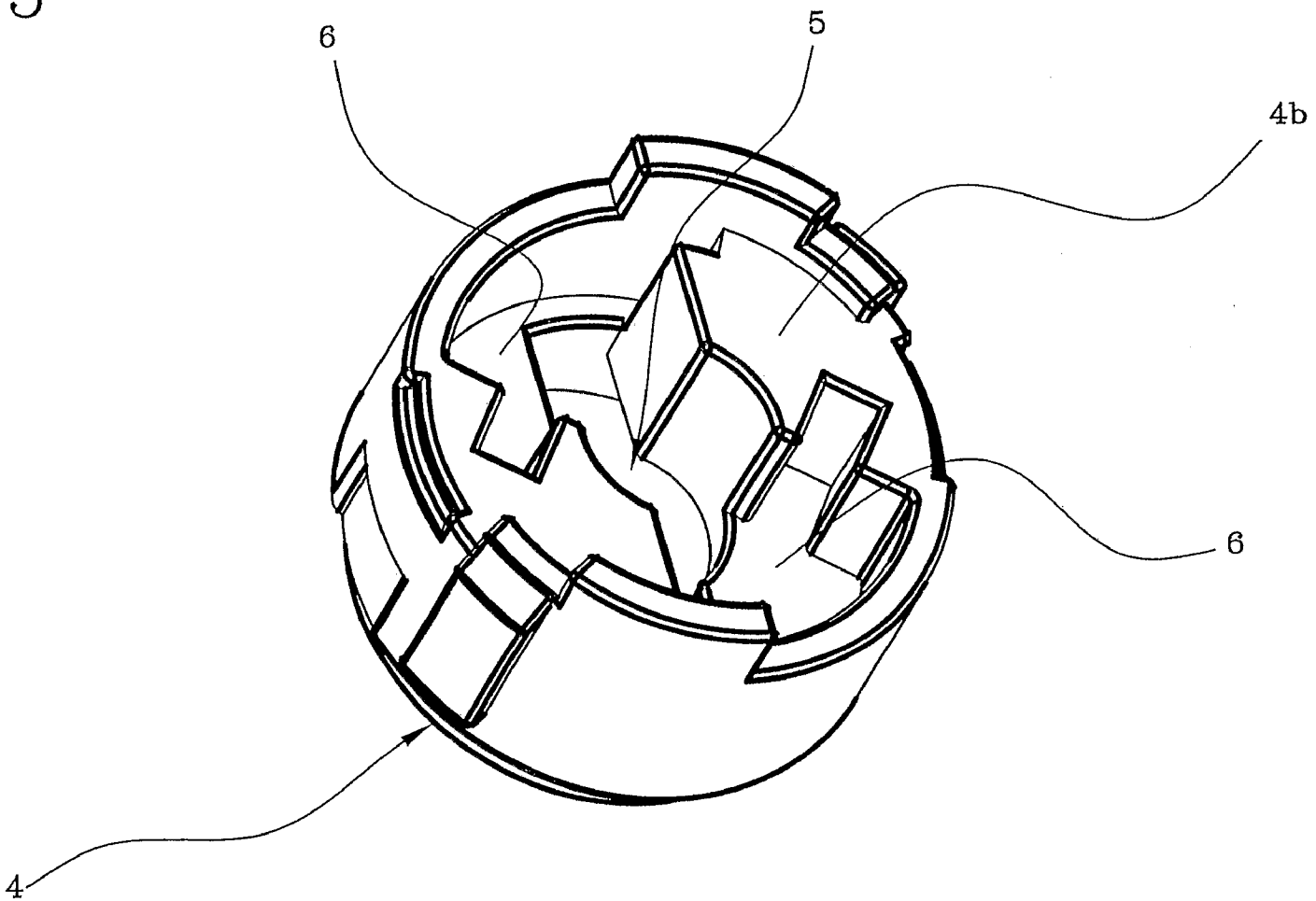
Figure 6:
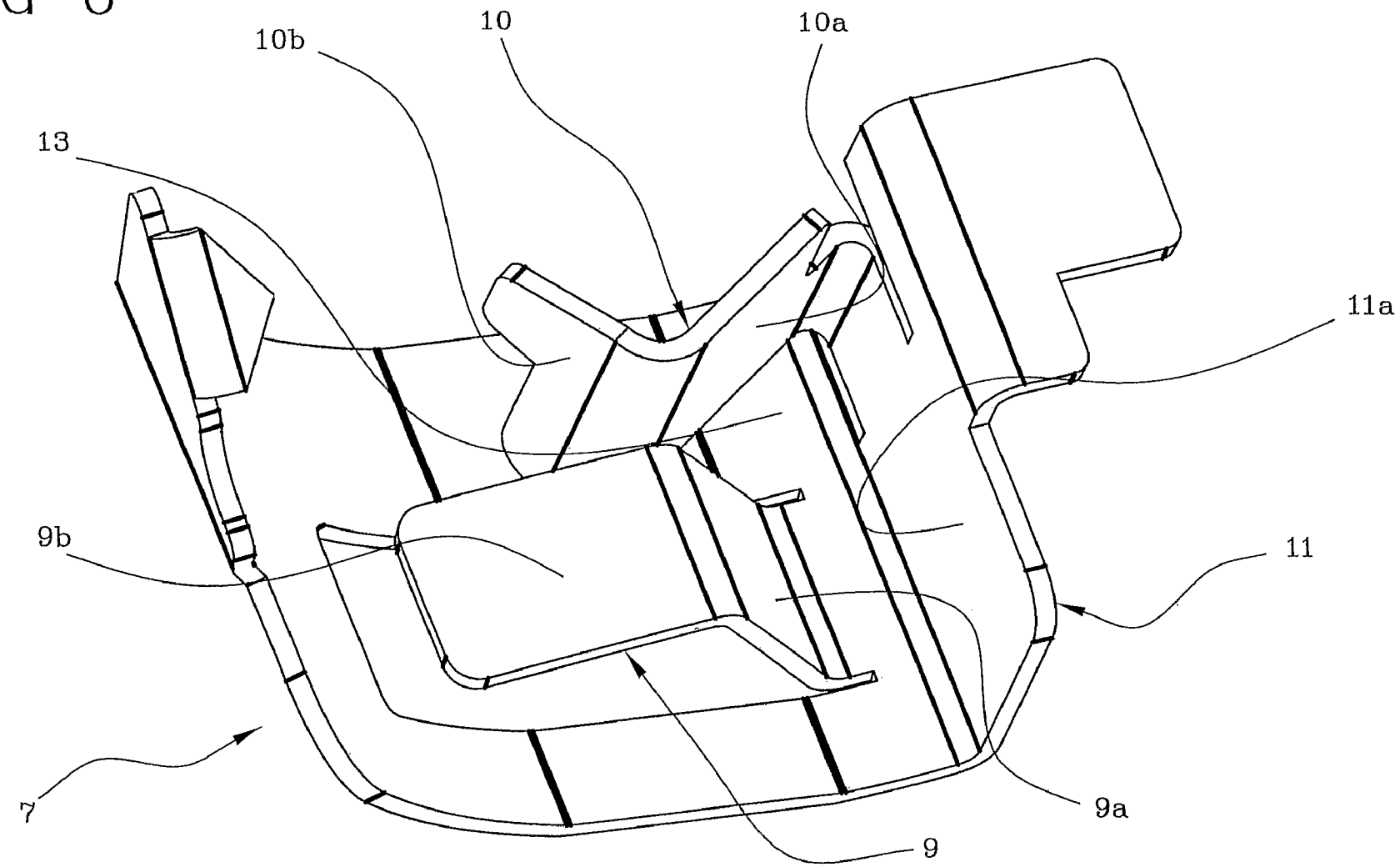
Figure 7:
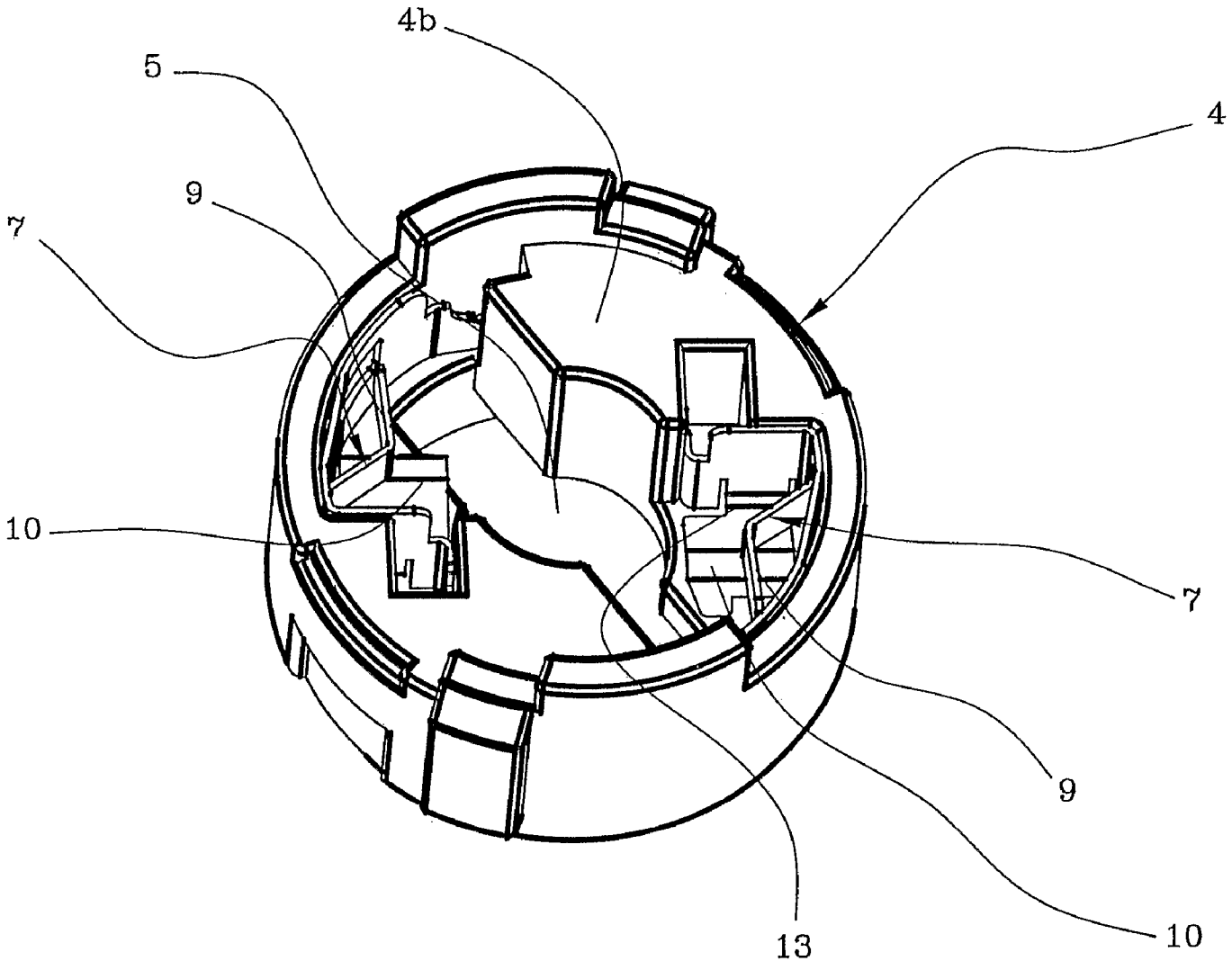
Figure 8:
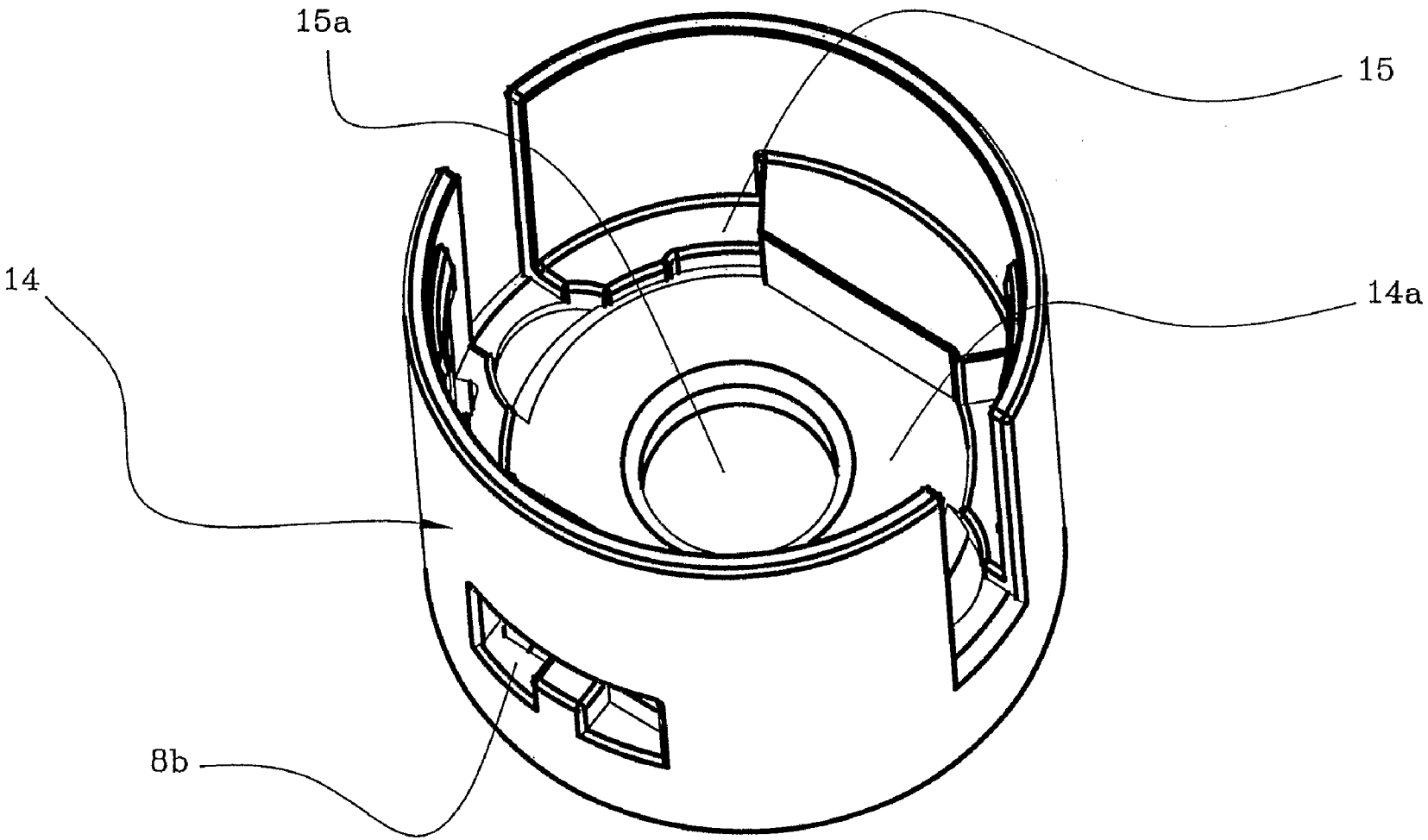
Figure 9:
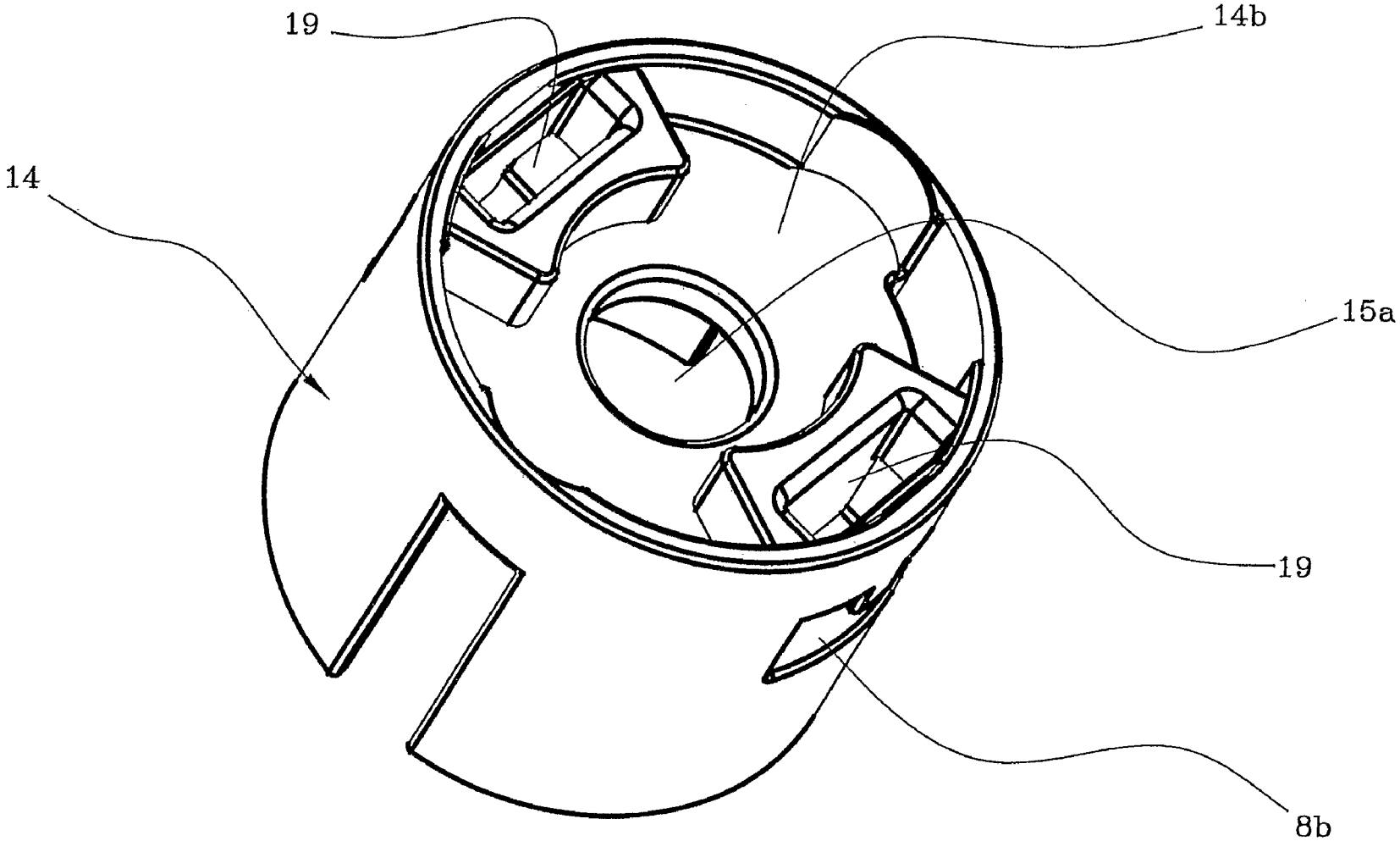
Figure 10:
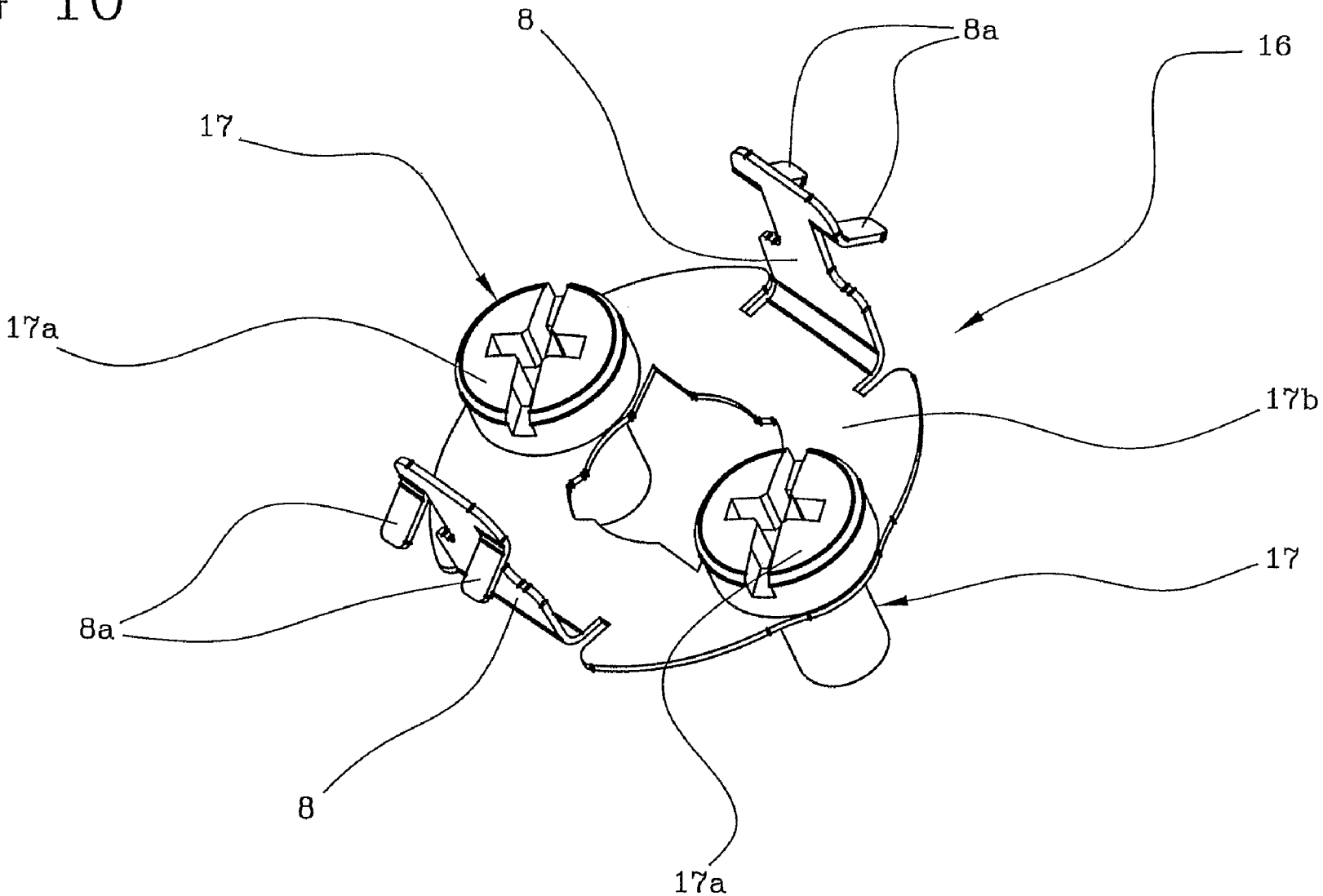
Figure 11:
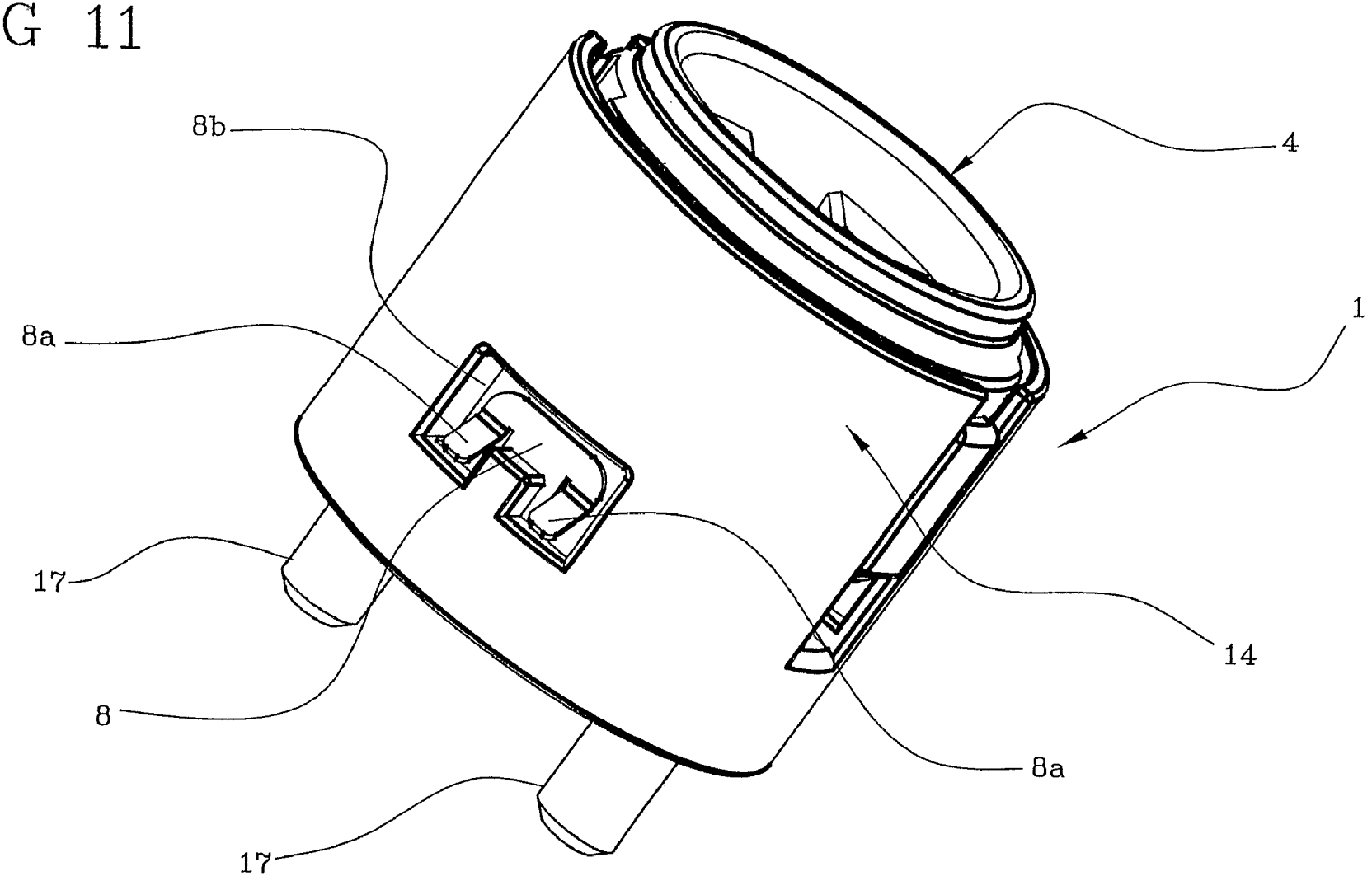
Figure 12:
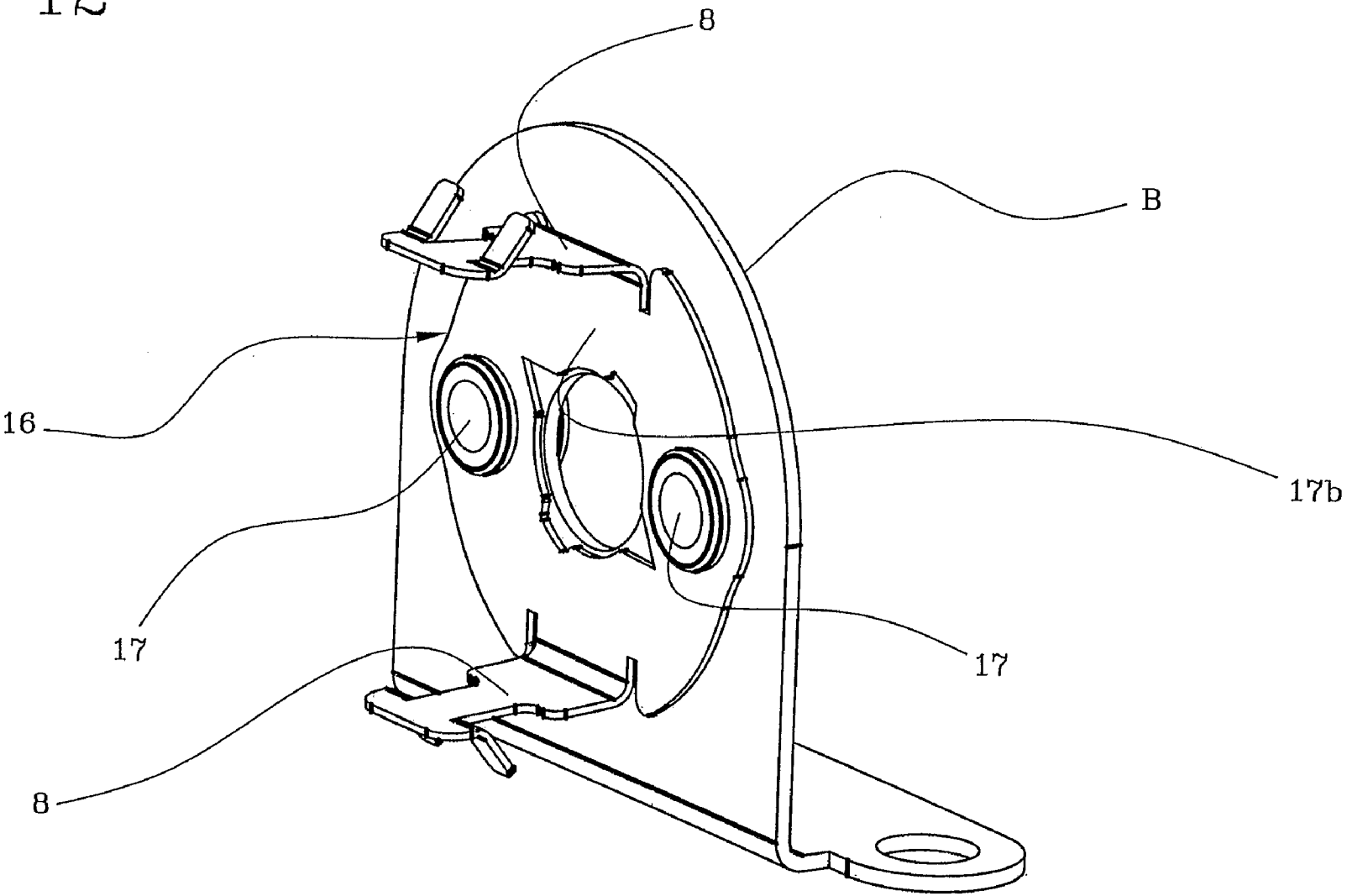
Figure 13:
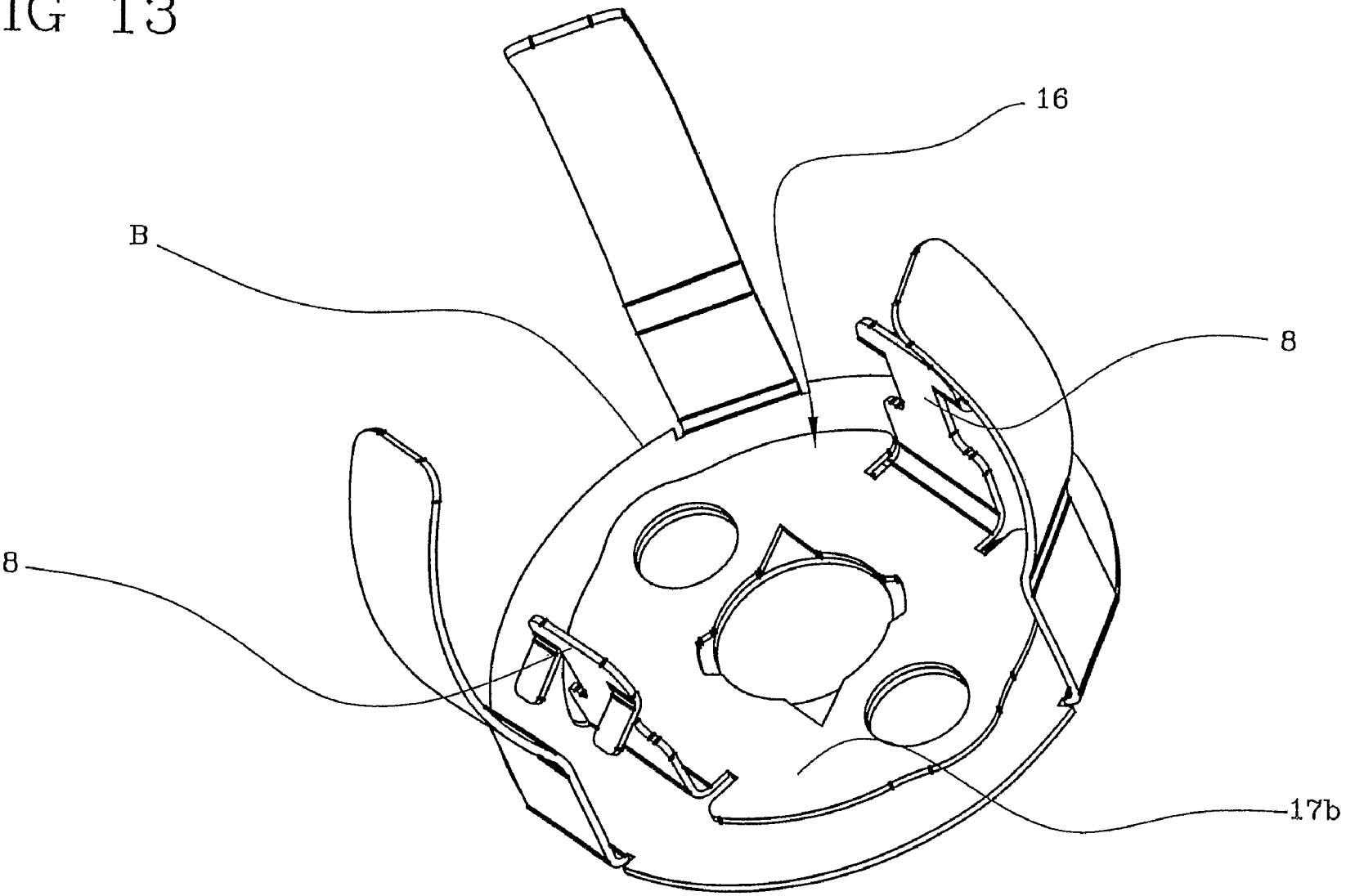

FIGS. 4 and 5 both show a construction detail of the device in FIG. 1 in front and rear perspective views, respectively;

FIG. 6 is a perspective view to an enlarged scale of an electric contact being part of the device in FIG. 1;

FIG. 7 shows the detail in FIG. 5 coupled with two electric contacts shown in FIG. 6;

FIGS. 8 and 9 both show a further construction detail of the device in FIG. 1 in front and rear perspective views, respectively;

FIG. 10 is a perspective view of a further construction detail of the holding device in accordance with the invention;

FIG. 11 shows a perspective view of the device seen in FIG. 2 coupled with the detail in FIG. 10;

FIG. 12 shows the construction detail seen in FIG. 10 in a first embodiment;

FIG. 13 shows the construction detail seen in FIG. 10 in a second embodiment.

DETAILED DESCRIPTION OF THE PREFERRED EMBODIMENTS OF THE INVENTION

With reference to the drawings, the lamp holding device in accordance with the invention has been generally denoted at 1.

It is to be pointed out that the present invention has been conceived in relation to lamps 2 of a new conception with a connection or base identified by the abbreviation PGJ5 having a rated voltage of 250V and an impulse voltage of 1500V.

A known lamp of this type presently on the market is the lamp Philips CDM 20 W, 250V with ballast ignition providing impulse discharges up to 1500 V, which is diagrammatically shown in FIGS. 1 and 14.

For the sake of clarity during the present description, identified by the term lamp is a lamp exclusively having the above mentioned features.

This lamp 2 consists of a light emitting bulb 2*a* made of glass or other transparent material. The bulb 2*a* has a substantially elongated conformation and extends along a respective longitudinal axis.

The lamp further has an end portion 3 of a substantially cylindrical conformation and extending from the opposite side of the bulb 2*a* along said longitudinal axis.

The end portion 3 has two conductive elements extending from respective opposite sides, along one identical direction transverse to the longitudinal extension of the end portion 3. Advantageously, each conductive element has a parallelepiped conformation with a square cross section in which four side walls are defined.

The holding device 1 comprises a hollow body 4 which is electrically insulated and is set to receive the end portion 3 of lamp 2. In detail, the hollow body 4 better shown in FIGS. 4, 5 and 7, is made of ceramic material, advantageously steatite, and has a substantially cylindrical conformation in which an outer surface 4*a* facing the bulb 2*a* of lamp 2 and an inner surface 4*b* facing the end portion 3 are defined.

The hollow body 4 further has a through slot 5 made in the middle of the hollow body 4 and set to receive the end portion 3 of lamp 2. In more detail, the slot 5 consists of a central hole 5*a* and two side portions 5*b* disposed on opposite sides of the central hole 5*a* and adapted to enable passage of the conductive elements of the end portion 3.

Two diametrically opposite apertures 6 are formed at the inner surface 4*b* of the body 4, each of said apertures being disposed in side by side relationship with a side portion 5*b* of the slot 5 (see in particular FIG. 5).

Figure 3:
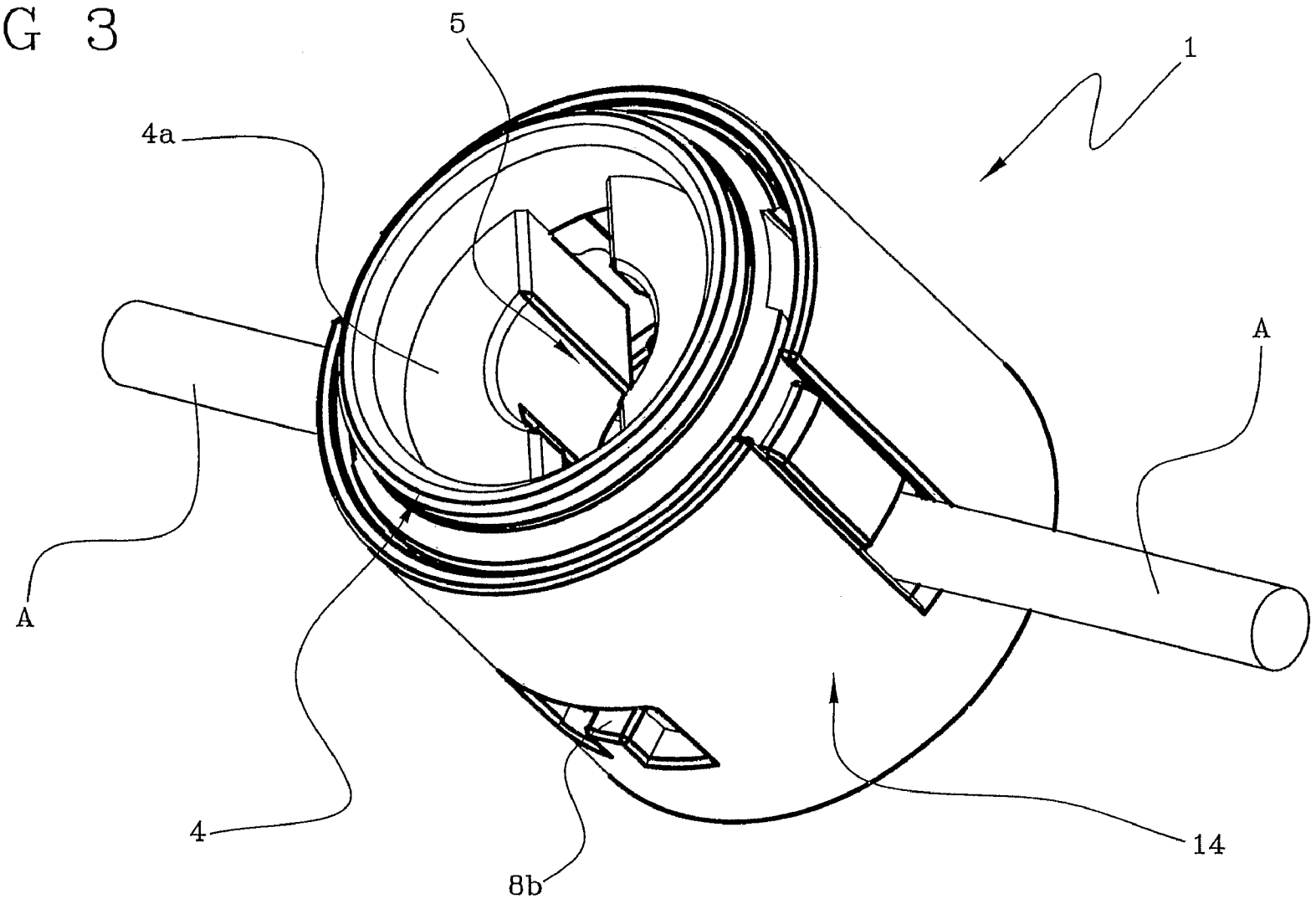
FIG. 3 shows a further perspective view of the device in FIG. 2 in a second possibility of use.

Each aperture 6 is suitably arranged and shaped for receiving an electric contact 7. In particular, each electric contact 7 is advantageously made of metal and can be associated with a respective conductive element projecting from the end portion 3 of the lamp 2 to connect the lamp 2 to suitable electric-energy transmitting means A shown in the accompanying drawings. In more detail, shown in FIG. 2 is a pair of cables A projecting from underneath the device. Alternatively, cables A can be disposed on opposite sides of the device, as shown in FIG. 3.

In particular, each electric contact 7 comprises a first and a second resilient counter-element 9, 10 both movable between an opened position to enable passage of the respective conductive element and a constraint position to lock said conductive element. Advantageously, each resilient counter-element 9, 10 has a contact surface 9*a*, 10*a* susceptible of abutment against a respective side wall of the conductive element of the lamp 2.

Still more particularly, as shown in FIG. 6, each electric contact 7 has a substantially laminar conformation and an arched extension so that it extends along the side wall of body 4.

The first and second resilient counter-elements 9, 10 consist of two portions projecting towards the centre of the hollow body 4, which are of laminar conformation as well. In detail, each resilient counter-element 9, 10 consists of a thin plate such bent as to define a slide surface 9*b*, 10*b* contiguous to the respective contact surface 9*a*, 10*a*.

The slide surfaces 9*b*, 10*b* are set to abut against the conductive element during movement of the respective resilient elements 9, 10 from the constraint position to the opened position, to enable passage of the conductive element, as better clarified in the following.

Advantageously, the first resilient counter-element 9 extends transversely of the second resilient counter-element 10, so that the respective surfaces 9*a*, 10*a* are disposed along respective planes perpendicular to each other.

In addition, each electric contact 7 further has an abutment element 11 facing the first resilient element 9 and having a respective surface 11*a*. The abutment element 11 too has a laminar conformation and the respective surface 11*a* is parallel to the contact surface 9*a* of the first resilient element 9 and set to abut against a side wall of the conductive element of lamp 2.

Under this situation, the first resilient counter-element 9, second resilient counter-element 10 and abutment element 11 define a holding space 13 for the respective conductive element (see in particular FIG. 7).

Advantageously, when the end portion 3 is inserted into the body 4, the conductive element appears to be adjacent to the slide surface 9*b* of the first resilient element 9 and out of the mentioned holding space 13. Following a rotation of lamp 2 around its longitudinal axis, the conductive element is brought towards the first and second resilient elements 9, 10 and abuts against the slide surfaces 9*a*, 10*a* thereof. Due to the thrust action of the conductive element on the first and second resilient elements 9, 10, said elements 9, 10 take their respective opened position to enable passage towards the holding space 13.

The resilient element 10 pushes the conductive element in parallel to the central axis of lamp 2 and in the opposite direction to said lamp 2, so that said lamp is maintained in contact with the upper surface 4*a* of the lamp holder.

In this manner the conductive element is located in the holding space 13 and three out of the four faces abut against the respective contact surfaces 9*a*, 10*a* and 11*a*.

The device 1 further comprises a supporting element 14 made of an electrically insulating material, preferably plastic material, and having a respective housing space 15 within which the above mentioned hollow body 4 is housed.

As better illustrated in FIG. 8, the supporting element 14 has a substantially cylindrical conformation in which an inner surface 14*a* is defined that is disposed in the housing space 15 and abuts against the inner surface 4*b* of the hollow body 4. Extending opposite to the inner surface 14*a* is an outer surface 14*b* set to abut against hooking means 16 described in more detail in the following.

Furthermore, the supporting element 14 has a passageway 15*a* connecting space 15 with the outer surface 14*b*. This passageway 15*a* is placed at a central position and is adapted to enable passage of the electric cables A secured to contacts 7 for current distribution.

As better shown in FIG. 2, the hollow body 4 appears to be fitted into the housing space 15 of the supporting element 14 in such a manner that only the outer surface 4*a* of the hollow body 4 is out of the supporting element. In this manner the whole hollow body 4 that, as above said, is made of a ceramic material and therefore has features of great fragility, appears to be protected by the supporting element 14.

It is also to be pointed down that the hollow body 4 can be in engagement in a reversible manner with the supporting element 14 by means of suitable connecting elements of known type and therefore not further described or illustrated in detail.

As above said, the device 1 further has hooking means 16 to secure the supporting element 14 to a frame, a ceiling light or any other support.

As shown in detail in FIG. 10, the hooking means 16 consists of a junction element 17*b* having a flat conformation. In particular, the junction element is made up of a holed disc having a substantially circular peripheral extension and in coaxial engagement with the outer surface 14*b* of the supporting element 14.

The hooking means 16 is further provided with a pair of screws 17 housed within respective cavities 18 made in the junction element 17*b*. Under this situation, the screws 17 have respective heads 17*a* facing the outer surface 14*b* of the supporting element 14.

Advantageously, the junction element 17*b* has at least one projecting portion 8 facing the supporting element and adapted to be inserted into a suitable opening 19 formed in the outer surface 14*b* (see in particular FIG. 8). In particular, the junction element 17*b* has two projecting portions 8, each of which has a flat spring 8*a* on top for engagement into a recess 8*b* formed in the supporting element 14 at said opening 19.

In this way, as shown in FIG. 11, the junction element 17*b* can be associated with the supporting element 14 through insertion of the projecting portions into the respective openings 19.

Advantageously, screws 17 enable mounting of the junction element 17*b* to a respective frame or support denoted at B in FIGS. 12 and 13 which is shown in two different embodiments both known and therefore not described in detail.

Illustrated in FIG. 12 is the junction element 17*b* associated with a support B having an L-shaped conformation and being part of a support structure of a protection glass, merely given by way of example.

Shown in FIG. 13 is the junction element 17*b* connected to a lamp support B arranged for insertion into a suitable housing space for lamps.

It is to be pointed out that advantageously the hooking means 16 can be associated with the device 1 also in the condition showing the hollow element 4 inserted into the housing space 15 of the supporting element 14.

Operation of the lamp holding device 1 in accordance with the invention described above mainly as regards structure, is as follows.

Firstly, lamp 2 is associated with the hollow element 4. In particular, the end portion 3 of lamp 2 is inserted into slot 5 as above described. Once insertion of the end portion 3 has been completed, the lamp 2 is rotated around its longitudinal axis. During this rotation each conductive element causes abutment of two side walls perpendicular to each other onto the slide surfaces 9*b*, 10*b* of the resilient counter-elements 9, 10. In this way the resilient elements 9, 10 take their respective opened positions letting the conductive element enter the holding space 13.

When the conductive element enters the holding space 13, it causes abutment of the first side wall against the surface 11*a* of the abutment element 11. Under this situation, due to the resilient features of the counter-elements 9, 10, the latter go back to their starting condition corresponding to the constraint position at which the contact surfaces 9*a*, 10*a* are in abutment on respective side walls of the conductive element. Advantageously, under this situation three out of the four side walls of each conductive element are in abutment against a respective surface and the conductive element is locked by means of the thrust action of the resilient elements 9, 10.

Subsequently, the hollow body 4 is inserted into the above described supporting element 14.

Preferably, the junction element 17*b* is coupled with the respective support B by means of said screws 17 and subsequently the supporting element 14 associated with the hollow body 4 is fitted on the projecting portions of the junction element to enable the flat spring 8*a* to engage the recess 8*b*.

The invention achieves important advantages.

First of all, the device enables the conductive elements of the lamp 2 to be steadily secured to the electric contacts 7. This is due to the fact that each contact element is associated with the respective electric contact 7 at three different points. Advantageously also following slight movements of the whole device, the lamp is in any case maintained in abutment on at least one surface 9*a*, 10*a*, 11*a*. In addition, by arranging two resilient counter-elements 9, 10 at right angles to each other, the conductive element of the lamp keeps locked within the holding space 13. Consequently, distribution of electric energy to the lamp 2 is always ensured. A further advantage resides in that the electric contacts are only compatible with conductive elements of a predetermined size. In other words, introduction and coupling of a lamp different from the intended one is not possible. This is due to the fact that the conductive elements have sizes corresponding to the specific type of lamp. Therefore, the holding space 13 set to receive a conductive element of given sizes is not able to receive conductive elements of different sizes or shapes that can be energised.

In addition, the shape of said contacts enables a soft insertion of the lamp and also enables detection of when a correct insertion and coupling has occurred due to snap fitting of the resilient portions; in addition it also allows energising only after the lamp has started rotation and not with the lamp insertion alone.

Advantageously, the device 1 can only be used for the intended type of lamp and other lamp types cannot be inserted into said holding space 13 and therefore cannot be dangerously energised.

Another advantage is represented by the positioning of screws 17 so that they do not run the risk of damaging the hollow body 4 when applied by the user to mount the lamp holder. In fact, said screws 17 are disposed on the junction element 17*b* and not directly on the hollow body 4 so that there is no risk of damages to the hollow body made of ceramic material.

In addition, due to the new positioning of the screw seats the mounting distance of the screws themselves can be advantageously freely varied depending on requirements, by selecting a distance between centres of 12 mm or also of 11.4 mm as in most of usual applications for lamp holders of very low voltage.

Furthermore, the supporting element 14 made of insulating material which is in contact with the screw heads 17*a* enables better insulation of the energised parts. As a result, the screws do not run the risk of being energised even in the event of possible breaking of the device.

There is also an important aesthetic improvement of the whole device concealing the screws under the outer surface 14*b* of the supporting element 14. Finally, another advantage resulting from the positioning of screws 17 consists in the reduced bulkiness of the whole device 1. This is due to the fact that the hollow body 4 is no longer designed to support said screws 17 which are engaged under the supporting element 14, so that a greater rotation of the lamp base in the lamp holder is obtained and therefore a better and steadier contact is achieved.

The invention claimed is:

1. A lamp holding device comprising at least:

one electrically insulating hollow body (4) set to receive an end portion (3) of a lamp (2);

one pair of electric contacts (7) disposed in said hollow body (4), each of which can be associated with a respective conductive element projecting from said end portion (3) of the lamp (2);

characterised in that each electric contact (7) comprises:

at least one first resilient counter-element (9) movable between an opened position to enable passage of the respective conductive element and a constraint position to lock said conductive element in place, said resilient counter-element (9) having a contact surface (9*a*) adapted to abut onto a respective side wall of the conductive element, and a second resilient counter-element (10) which too is movable between an opened position to enable passage of the respective conductive element and a constraint position to lock said conductive element in place and having a contact surface (10*a*) adapted to abut onto a respective side wall of the conductive element, wherein said first resilient counter-element (9) extends transversely of the second resilient counter-element (10), said surfaces (9*a*, 10*a*) of the first and second resilient counter-elements (9, 10) being transverse to each other.

2. A device as claimed in claim 1, wherein said pair of conductive elements projecting from said end portion (3) of the lamp (2) extend opposite each other and transversely to a longitudinal extension of the lamp.

3. A device as claimed in claim 1, the device having a structure which matches with a structure of a connection or base of the PGJ5 type.

4. A device as claimed in claim 1, characterised in that it further comprises;

a supporting element (14) made of an electrically insulating material and having a housing space (15); and hooking means (16) to secure the supporting element (14) to a frame;

said hollow body (4) being disposed in said housing space (15) and said hooking means (16) comprising at least one junction element (17*b*) having a substantially flat conformation and at least one through cavity (18) formed in said junction element (17*b*) to house at least one screw (17).

5. A device as claimed in claim 1, characterised in that one of said resilient counter-elements (9, 10) is apt to push the conductive element in parallel to the central axis of the lamp (2), so as to keep the lamp (2) in contact with an upper surface (4*a*) of the lamp holder.

6. A device as claimed in claim 1, characterised in that each electric contact (7) further comprises an abutment element (11) facing the first resilient element (9) and having a respective surface (11*a*) adapted to abut onto a side wall of the conductive element; the first resilient counter-element (9) being apt to be active to push said conductive element into contact with said abutment element (11); said first resilient counter-element (9), second resilient counter-element (10) and abutment element (11) defining a holding space (13) for the respective conductive element.

7. A device as claimed in claim 1, characterised in that said contact surfaces (9*a*, 10*a*) of the first and second resilient counter-elements (9, 10) extend at right angles to each other.

8. A device as claimed in claim 1, characterised in that said first resilient counter-element (9) has a substantially laminar conformation and is provided with a slide surface (9*b*) contiguous to the respective contact surface (9*a*); said slide surface (9*b*) being set to abut onto the conductive element during movement of the first element (9) from the respective constraint position to the opened position to enable passage of the conductive element.

9. A device as claimed in claim 1, characterised in that said second resilient counter-element (10) has a substantially laminar conformation and is provided with a slide surface (10*b*) contiguous to the respective contact surface (10*a*); said slide surface (10*b*) being set to abut onto the conductive element during movement of the second element (10) from the respective constraint position to the opened position to enable passage of the conductive element.

10. A device as claimed in claim 1, wherein the hollow body (4) has a through slot (5) formed therein and set to receive the end portion (3) of the lamp (2), wherein the through slot (5) has a substantially elongated shape in which two opposite ends are defined to enable passage of the conductive elements.

11. A device as claimed in claim 10, wherein, when the lamp (2) is inserted into the through slot (5) and rotated around a longitudinal axis of the lamp, said pair of conductive elements projecting from said end portion (3) of the lamp (2) are respectively disposed in correspondence with said pair of electric contacts (7).

12. A device as claimed in claim 10, characterised in that said hollow body (4) has a substantially cylindrical conformation in which an outer surface (4*a*) for facing a bulb (2*a*) of the lamp (2) and an inner surface (4*b*) for facing said end portion (3) are defined.

13. A device as claimed in claim 12, characterised in that said electric contacts (7) are disposed in respective apertures (6) made in the inner surface (4*b*) of the hollow body (4) on opposite sides of the through slot (5).

14. A device as claimed in claim 12, wherein said device further comprises a supporting element (14) made of an electrically insulating material and having a housing space (15), and hooking means (16) to secure the supporting element (14) to a frame; said hollow body (4) being disposed in said housing space (15), characterised in that said supporting element (14) has a substantially cylindrical conformation in which there is defined an inner surface (14*a*) disposed in said housing space (15) and adapted to abut onto the inner surface (4*b*) of the hollow body (4), as well as an outer surface (14*b*) opposite to the inner surface (14*a*).

15. A lamp holding device comprising at least:

one electrically insulating hollow body (4) set to receive an end portion (3) of a lamp (2);

one pair of electric contacts (7) disposed in said hollow body (4), each of which can be associated with a respective conductive element projecting from said end portion (3) of the lamp (2);

wherein each electric contact (7) comprises:

at least one first resilient counter-element (9) movable between an opened position to enable passage of the respective conductive element and a constraint position to lock said conductive element in place, said resilient counter-element (9) having a contact surface (9*a*) adapted to abut onto a respective side wall of the conductive element, and a second resilient counter-element (10) which too is movable between an opened position to enable passage of the respective conductive element and a constraint position to lock said conductive element in place and having a contact surface (10*a*) adapted to abut onto a respective side wall of the conductive element, and wherein one of said resilient counter-elements (9, 10) is apt to push the conductive element in parallel to the central axis of the lamp (2), so as to keep the lamp (2) in contact with an upper surface (4*a*) of the lamp holder.

16. A device as claimed in claim 15, the device having a structure which matches with a structure of a connection or base of the PGJ5 type.

17. A device as claimed in claim 15, wherein said first resilient counter-element (9) has a substantially laminar conformation and is provided with a slide surface (9*b*) contiguous to the respective contact surface (9*a*); said slide surface (9*b*) being set to abut onto the conductive element during movement of the first element (9) from the respective constraint position to the opened position to enable passage of the conductive element, and wherein said second resilient counter-element (10) has a substantially laminar conformation and is provided with a slide surface (10*b*) contiguous to the respective contact surface (10*a*); said slide surface (10*b*) being set to abut onto the conductive element during movement of the second element (10) from the respective constraint position to the opened position to enable passage of the conductive element.

18. A device as claimed in claim 15, wherein the hollow body (4) has a through slot (5) formed therein and set to receive the end portion (3) of the lamp (2), and wherein, when the lamp (2) is inserted into the through slot (5) and rotated around a longitudinal axis of the lamp, said pair of conductive elements projecting from said end portion (3) of the lamp (2) are respectively disposed in correspondence with said pair of electric contacts (7).

19. A device as claimed in claim 15, wherein said first resilient counter-element (9) extends transversely of the second resilient counter-element (10), said surfaces (9*a*, 10*a*) of the first and second resilient counter-elements (9, 10) being transverse to each other.

20. A device as claimed in claim 19, wherein each electric contact (7) further comprises an abutment element (11) facing the first resilient element (9) and having a respective surface (11*a*) adapted to abut onto a side wall of the conductive element; the first resilient counter-element (9) being apt to be active to push said conductive element into contact with said abutment element (11); said first resilient counter-element (9), second resilient counter-element (10),and abutment element (11) defining a holding space (13) for the respective conductive element.

21. A lamp holding device comprising at least:

one electrically insulating hollow body (4) set to receive an end portion (3) of a lamp (2);

one pair of electric contacts (7) disposed in said hollow body (4), each of which can be associated with a respective conductive element projecting from said end portion (3) of the lamp (2);

wherein each electric contact (7) comprises:

at least one first resilient counter-element (9) movable between an opened position to enable passage of the respective conductive element and a constraint position to lock said conductive element in place, said resilient counter-element (9) having a contact surface (9*a*) adapted to abut onto a respective side wall of the conductive element, and a second resilient counter-element (10) which too is movable between an opened position to enable passage of the respective conductive element and a constraint position to lock said conductive element in place and having a contact surface (10*a*) adapted to abut onto a respective side wall of the conductive element, wherein the hollow body (4) has a through slot (5) formed therein and set to receive the end portion (3) of the lamp (2) and wherein, when the lamp (2) is inserted into the through slot (5) and rotated around a longitudinal axis of the lamp, said pair of conductive elements projecting from said end portion (3) of the lamp (2) are respectively disposed in correspondence with said pair of electric contacts (7).

22. A device as claimed in claim 21, the device having a structure which matches with a structure of a connection or base of the PGJ5 type.

23. A lamp holding device comprising at least:

one electrically insulating hollow body (4) set to receive an end portion (3) of a lamp (2);

one pair of electric contacts (7) disposed in said hollow body (4), each of which can be associated with a respective conductive element projecting from said end portion (3) of the lamp (2);

wherein each electric contact (7) comprises:

at least one first resilient counter-element (9) movable between an opened position to enable passage of the respective conductive element and a constraint position to lock said conductive element in place, said resilient counter-element (9) having a contact surface (9*a*) adapted to abut onto a respective side wall of the conductive element, and a second resilient counter-element (10) which too is movable between an opened position to enable passage of the respective conductive element and a constraint position to lock said conductive element in place and having a contact surface (10*a*) adapted to abut onto a respective side wall of the conductive element, wherein said device further comprises:

a supporting element (14) made of an electrically insulating material and having a housing space (15); and hooking means (16) to secure the supporting element (14) to a frame;

said hollow body (4) being disposed in said housing space (15), wherein said hooking means (16) comprises at least one junction element (17*b*) having a substantially flat conformation and at least one through cavity (18) formed in said junction element (17*b*) to house at least one screw (17), and wherein said junction element (17*b*) comprises at least two resilient portions (8) projecting towards said supporting element (14) and adapted for insertion into the supporting element (14) in respective openings (19) formed in the supporting element (14) so that in a use position they are housed in the supporting element (14) itself.

24. A device as claimed in claim 23, characterised in that said hooking means (16) comprises at least two through cavities (18) formed in said junction element (17*b*) to house two screws (17) disposed with their heads (17*a*) turned towards the outer surface (14*b*) of the supporting element (14).

25. A device as claimed in claim 23, characterised in that each projecting portion (8) comprises at least one flat spring (8*a*) to be resiliently engaged in said opening (19) of the supporting element (14).

* * * * *